US006883896B2

(12) United States Patent
Umeda

(10) Patent No.: US 6,883,896 B2
(45) Date of Patent: Apr. 26, 2005

(54) INK JET RECORDING APPARATUS

(75) Inventor: Takaichiro Umeda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/397,873

(22) Filed: Mar. 27, 2003

(65) Prior Publication Data

US 2003/0184612 A1 Oct. 2, 2003

(30) Foreign Application Priority Data

Mar. 29, 2002 (JP) ..... 2002-097279

(51) Int. Cl.[7] ..... B41J 2/165
(52) U.S. Cl. ..... 347/29; 347/30; 347/33
(58) Field of Search ..... 347/22–24, 29, 347/30, 33, 35

(56) References Cited

FOREIGN PATENT DOCUMENTS

| | | | |
|---|---|---|---|
| JP | A-3-136859 | | 6/1991 |
| JP | U-6-27147 | | 4/1994 |
| JP | A-7-137271 | | 5/1995 |
| JP | A-10-193648 | | 7/1998 |
| JP | 410193648 A | * | 7/1998 |
| JP | A-11-138829 | | 5/1999 |
| JP | A-11-342633 | | 12/1999 |
| JP | B1-3039641 | | 3/2000 |
| JP | A-2001-47635 | | 2/2001 |
| JP | A-2001-270135 | | 10/2001 |
| JP | A-2001-277543 | | 10/2001 |

* cited by examiner

*Primary Examiner*—Shih-Wen Hsieh
(74) *Attorney, Agent, or Firm*—Oliff & Berridge, PLC

(57) ABSTRACT

A maintenance unit of an ink jet recording apparatus includes a maintenance motor, a cap member that covers nozzles of a print head, a wiper that wipes ink off a nozzle opening area after a cleaning operation for the print head, a suction pump that suctions the ink, a switching valve that includes a plurality of suction ports connected to the cap member, the wiper, and an ink receiver and a discharge port connected to the suction pump, and a cam that controls a rotating angle of the switching valve. The maintenance motor, the suction pump, the switching valve, and the cam are connected by a plurality of gears. The ink discharged during wiping and flushing operations, as well as the cleaning operation, is selectively suctioned by the maintenance unit.

21 Claims, 6 Drawing Sheets

INK JET RECORDING APPARATUS

BACKGROUND OF THE INVENTION

1. Field of Invention

The invention relates to an ink jet recording apparatus and more particularly, to an ink suction mechanism.

2. Description of Related Art

An ink jet printer performs printing by ejecting ink from nozzles of a print head onto a recording medium. Viscous ink resulting from an evaporation of a solvent through nozzle openings, solidified ink, dust attached to the print head, or air bubble included in the ink affect the printing operation or printing quality. To prevent the adverse effects on the printing operation or the printing quality, the nozzle openings of the print head are covered by a cap member when the print head is idle. When necessary, a cleaning operation for the print head is performed by suctioning the ink from the nozzles to clear nozzle clogging caused by solidified ink, fine dust or foreign material, or air bubbles included in the ink. As the ink is suctioned from the nozzles during the cleaning operation, a nozzle surface is wet with ink. To prevent poor printing operation, the ink on the nozzle surface is wiped off by a wiping member.

In a drop-on-demand ink jet printer that ejects, based on print data, ink droplets only when they are needed to print on a recording media, as the nozzles are less frequently operated, ink viscosity or ink colorant density will be increased, leading to unstable ink ejection or no ink ejection. To remove the viscous ink from the nozzles, a flushing operation for recovering ink ejecting performance of the nozzles is periodically performed during the printing operation.

The ink suctioned during the cleaning operation is discharged into a waste ink tank, using, for example, a pump. Because an amount of the ink ejected during the flushing operation is relatively small as compared with the amount of the ink suctioned during the cleaning operation, the ink ejected from the print head by the flushing operation during the printing operation is absorbed material, such as a spongy foam. The ink wiped by the wiping member is not suctioned into a tank or absorbed in an absorbing material, because the wiping member only wipes off such a small amount of the ink that stays on the print head due to the surface tension.

When a large-volume printing job is performed, such as on a business scene, or when an hour-long printing separation is performed, the amount of the ink absorbed or wiped during the flushing or wiping operation increases. The ink jet printer may eventually become dirty with the ink if the ink attached to the wiping member is not removed. The absorbing material that absorbs the ink ejected during the flushing operation may have to be replaced frequently according to the absorbing capacity of the absorbing material. Providing an absorbing material large enough to accommodate an operating life of the ink jet printer does not satisfactorily meet the demands on the downsizing of the ink jet printer and further leads to increases in manufacturing costs.

SUMMARY OF THE INVENTION

Accordingly, one aspect of this invention is to provide an ink jet recording apparatus that selectively suctions ink ejected during wiping and flushing operations, as well as a print head cleaning operation.

An ink jet recording apparatus according to an exemplary embodiment of this invention may include a print head that includes nozzles and forming an image onto a recording medium by ejecting ink from the nozzles, a cap member that covers the nozzles of the print head, a wiping member that wipes off the ink on a nozzle surface, an ink receiver that receives the ink ejected from the print head at a region outside an image recordable area with the print head, a suction pump for suctioning the ink, and a switching mechanism that communicates with the cap member, the wiping member, the ink receiver, and the suction pump, the switching mechanism allowing the suction pump to selectively communicate with the cap member, the wiping member, and the ink receiver.

BRIEF DESCRIPTION OF THE DRAWINGS

An exemplary embodiment of the invention will be described in detail with reference to the following figures wherein.

DETAILED DESCRIPTION OF PREFERRED EMBODIMENTS

An exemplary embodiment of the invention will be described in detail with reference to the figures.

Figure 1:
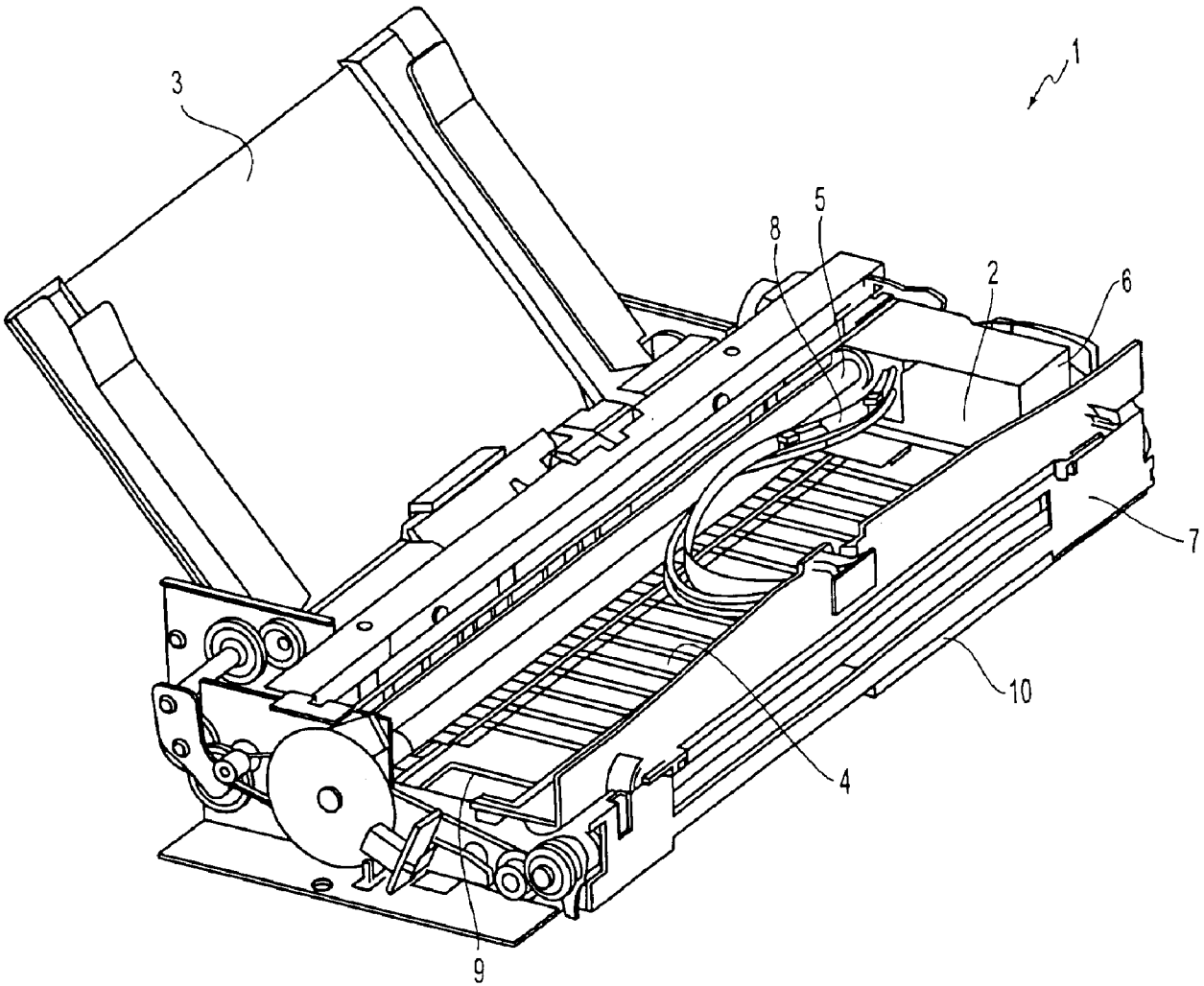
FIG. 1 is a perspective view of an ink jet printer according to an exemplary embodiment of the invention.

FIG. 1 is a perspective view of an ink jet printer 1 according to an embodiment of the invention. In this embodiment, the ink jet printer 1 is a color ink jet printer that employs ink of a plurality of colors. As shown in FIG. 1, an ink jet printer 1 includes a print head 2 that performs printing by ejecting ink onto a recording medium, a sheet tray 3 that mounts thereon a stack of the recording media, a ribbed platen 4 that maintains the recording medium fed from the sheet tray 3 by transfer rollers parallel to the print head 2, and a maintenance unit 10 that performs a cleaning operation for the print head 2 and ink suction operation. The recording medium having an image formed thereon is discharged out of the ink jet printer 1 by discharge rollers (not shown).

The print head 2 is mounted on a carriage 6 that is slidable along a guide shaft 5 and a guide rail supported by a chassis 7. The print head 2 performs a printing operation while the carriage 6 is driven by a carriage motor and is reciprocated. The print head 2 includes nozzles that eject ink therefrom onto the recording medium. The ink is supplied to the print head 2 through an ink tube 8 from an ink tank disposed at a lower portion of the chassis 7. The printing operation is performed by ejecting the thus supplied ink from the nozzles onto the recording medium. The recording medium is set on the upper face of the sheet tray 3 and fed by rollers, such as the transfer rollers, provided inside the chassis 7. After an image has been formed on the recording medium with the print head 2, the recording medium is discharged by the discharge roller out of the ink jet printer 1. The print head 2 periodically performs a flushing operation to prevent nozzle clogging and recover ink ejecting performance of the nozzles, at a flushing area during the printing operation. The ink ejected from the nozzles during the flushing operation is received by an ink receiver 9 provided in the flushing area. The maintenance unit 10 for performing the cleaning operation for the print head 2 and for suctioning ink collected by the cleaning operation is provided in a standby area opposite to the flushing area where the ink receiver 9 is disposed.

Figure 2:
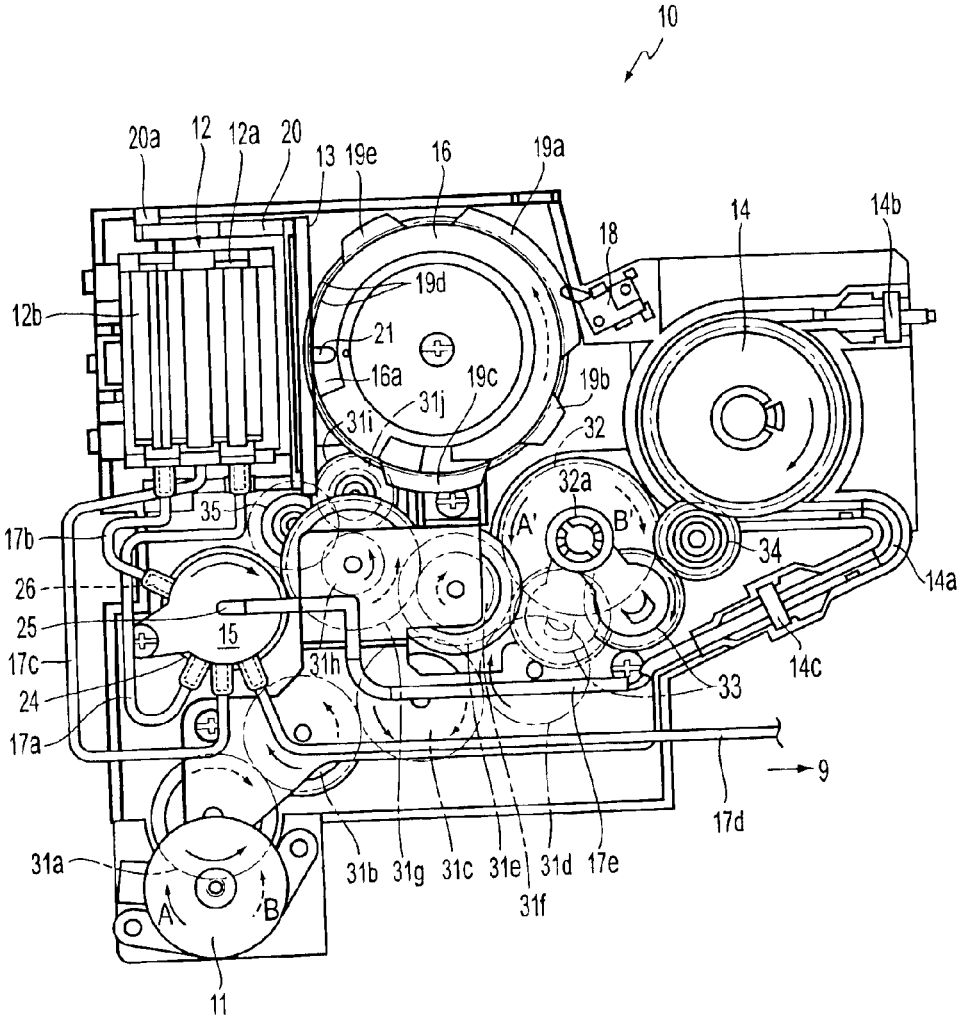
FIG. 2 is a plan view of a maintenance unit of the ink jet printer.

FIG. 2 is a plan view of the maintenance unit 10. The maintenance unit 10 includes a maintenance motor 11, a cap member 12 that covers the nozzles of the print head 2, a wiper 13 that wipes the ink off a nozzle opening area after the cleaning operation, a suction pump 14 for suctioning the ink, a switching valve 15 of a switching mechanism that includes a plurality of suction ports 26 connected to the cap member 12, the wiper 13, and the ink receiver 9 and a discharge port 25 connected to the suction pump 14, and a cam 16 that controls a rotation angle of the switching valve 15. The maintenance motor 11, the suction pump 14, the switching valve 15, and the cam 16 are connected by a plurality of gears 31*a*–3*j*, 32, 33, 34, 35. The cap member 12 includes two caps 12*a*, 12*b* . Each cap 12*a*, 12*b* has a suction opening. The suction opening formed in each cap 12*a*, 12*b* is connected to the switching valve 15 through a tube 17*a*, 17*b*, respectively.

Figure 8:
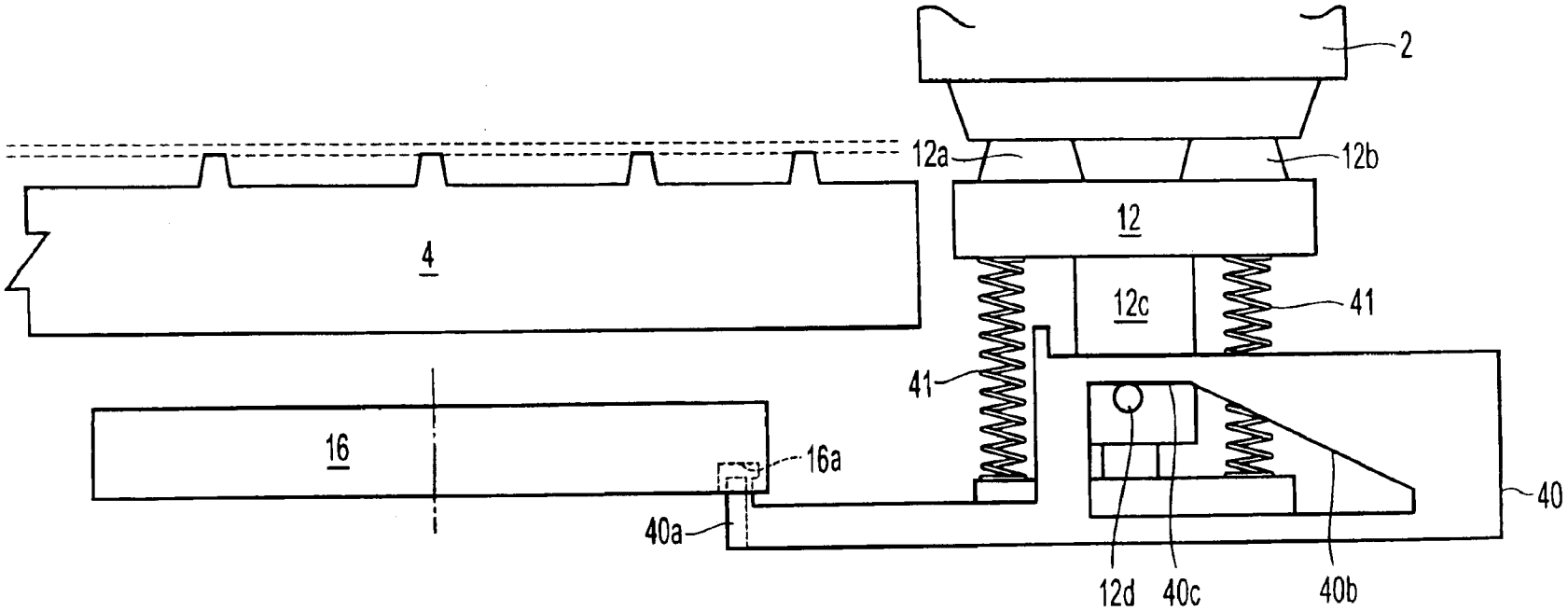
FIG. 8 is an enlarged side view of a cap member and a cam of the maintenance unit, and a print head when the ink jet printer is in a standby condition.

As shown in FIG. 8, the cap member 12 is provided with a shaft 12*c* below the caps 12*a*, 12*b*. The shaft 12*c* has a pin 12*d* extending therefrom perpendicular to the shaft 12*c*. Disposed below the cam member 12 is a guide member 40. The guide member 40 includes a guide pin 40*a* that fits into a guide groove 16*a* formed on a lower end of the cam 16, and cam surfaces 40*b*, 40*c* that contacts the pin 12*d* and controls the movement of the cap member 12. As the cam 16 is rotated, the guide member 40 is reciprocated to the right or left side in FIG. 8.

When the print head 2 is in the standby area as shown in FIG. 8, the cap member 12 is moved upwardly by the springs 41 to cover the print head 2. At this time, the pin 12*d* contacts the cam surface 40*c*. As the cam 16 is rotated, for example, to move the print head 2 away from the standby area, the guide member 40 is moved to the left in FIG. 8 and accordingly, the pin 12*d* makes contact with the cam surface 40*b*. Thus, the cap member 12 is moved down against an urging force of the springs 41 and uncovers the nozzles of the print head 2.

When the cleaning operation is performed for the print head 2, the ink is suctioned from the nozzles with the nozzles being covered by the cap member 12. After the cleaning operation is finished, the nozzle opening area is wet with the ink. The ink attached to the nozzle opening areas hinders the proper ink ejection, so that the ink remaining in the nozzle opening area is removed by the wiper 13. The wiper 13 is moved up to make contact with the nozzle opening area, and wipes the ink off the nozzle opening area as the print head 2 is moved. The wiper 13 also has a suction opening connected to the switching valve 15 through a tube 17*c*. The ink wiped by the wiper 13 is suctioned through the suction opening of the wiper 13.

The suction pump 14 is a tube pump that generates negative pressure by using changes in volumetric capacity of a flexible suction pump tube 14*a*. One end of the suction pump tube 14*a* is connected to a waste ink reservoir for storing waste ink, through a tube connector 14*b* and a tube (not shown). The other end of the suction pump tube 14*a* is connected to the discharge port 25 of the switching valve 15, through a tube connector 14*c* and a tube 17*e*. The suction pump tube 14*a* is fitted in a groove formed in the suction pump 14. A pressure application roller (not shown) is provided in the suction pump 14 so as to contact the suction pump tube 14*a*. When the negative pressure is generated, the pressure application roller presses the suction pump tube 14*a* according to the rotation of the suction pump 14. The ink is suctioned through the switching valve 15 and the tube 17*e*, by the application of the negative pressure caused by the changes in the volumetric capacity of the suction pump tube 14*a* pressed by the pressure application roller. The suctioned ink is discharged to the waste ink reservoir, through the tube (not shown).

The cam 16 is driven together with the switching valve 15. The cam 16 has the guide groove 16*a* at the lower end thereof, as shown in FIG. 8. The guide groove 16*a* is fitted over the guide pin 40*a* of the guide member 40 for moving the cap member 12 up and down to cap and uncap the print head 2. Provided on the periphery of the cam 16 are a cam 16*a* for moving the wiper 13 up and down for the wiping operation, as well as a plurality of protrusions 19*a*–19*e* that turn on or off a leaf switch 18 for detecting a rotational position of the cam 16, by making contact with or out of contact with the leaf switch 18. The wiper 13 is attached to a link 20 that is pivotable about a shaft 20*a*, such that the wiper 13 can move up and down. The wiper 13 is normally urged downwardly to a retracted position where the wiper 13 does not contact a nozzle surface of the print head 2. A pin 21 extends from the link 20. As the pin 21 raises the cam 16*a*, the wiper 13 is raised to a position where the wiper 13 can contact the nozzle surface of the print head 2.

Figure 3:
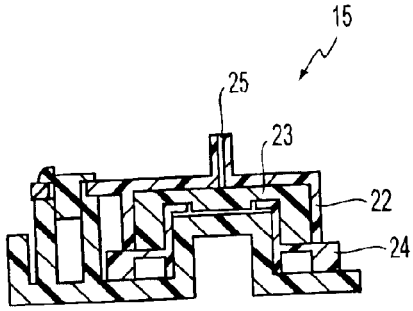
FIG. 3 is a cross sectional view of a switching mechanism of the maintenance unit.
Figure 4:
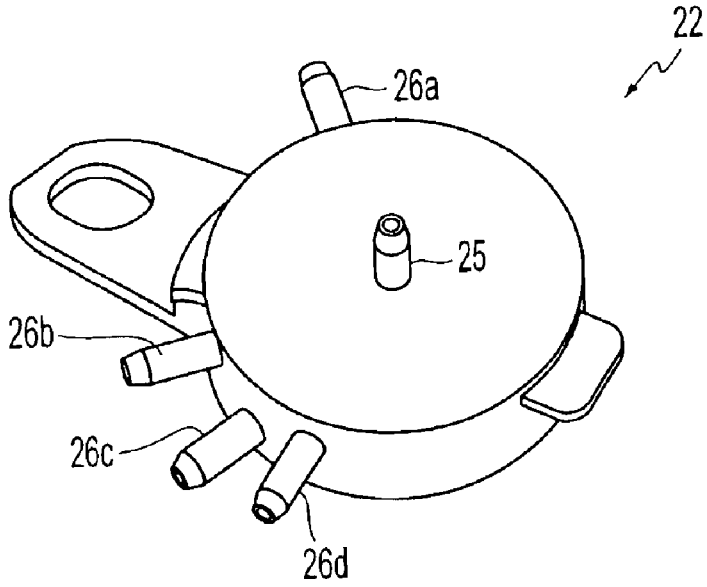
FIG. 4 is a perspective view of a main body of the switching mechanism.

The switching valve 15 will be described with reference to FIGS. 3 to 6B. As shown in FIG. 3, the switching valve 15 includes a cylindrical main body 22, a switching member 23 rotatably fitted in the cylindrical main body 22, and a switching gear member 24 that rotates about a shaft extending upwardly from a base of the maintenance unit 10 to allow the switching member 23 to rotate relative to the main body 22. The main body 22 is made of resin material. As shown in FIG. 4, provided on the upper surface of the main body 22 is the discharge port 25. The main body 22 is provided on an outer side surface thereof with a plurality of suction ports 26*a*–26*d*. The suction ports 26*a*–26*d* are not disposed at the same level on the outer side surface of the main body 22. More specifically, the suction ports 26*b*, 26*a* 26*d* that are connected to the caps 12*a*, 12*b* and the ink receiver 9 through the tubes 17*a*, 17*b*, 17*d*, respectively, are provided at upper portions of the outer side surface of the main body 22. The suction port 26*c* that is connected to the wiper 13 through the tube 17*c* is provided at a lower portion of the outer side surface of the main body 22. The upward and downward movement of the cap member 12 and the wiper 13, as well as the operation of the switching valve 15 are performed in synchronization with the movement of the cam 16, as described above. As shown in FIG. 4, the suction ports 26*b*–26*d* are disposed relatively close to each other. If the suction ports 26*b*–26*d* are provided close to each other on the same level on the outer side surface of the main body 22, the rotation angle of the switching valve 15 has to be precisely controlled to prevent the wrong selection of the suction ports 26*b*–26*d*. However, the switching valve 15 according to the embodiment can perform the switching operation without requiring a precise rotating angle control for the switching valve 15, due to the different level arrangement of the suction ports 26*a*–26*d*.

Figure 5:
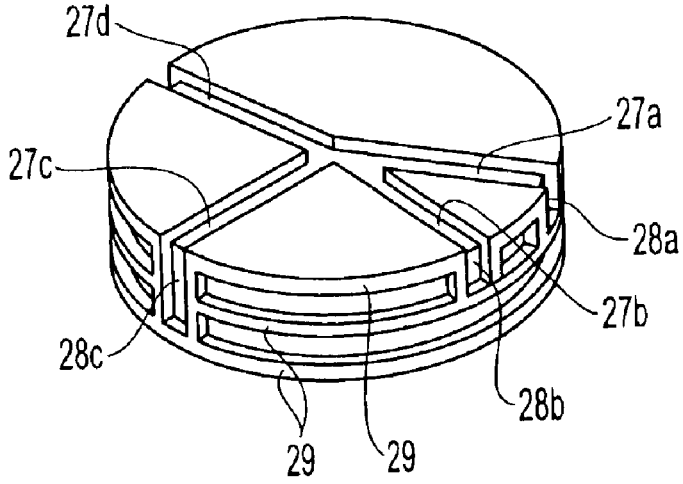
FIG. 5 is a perspective view of a switching member of the switching mechanism.
Figure 6A:
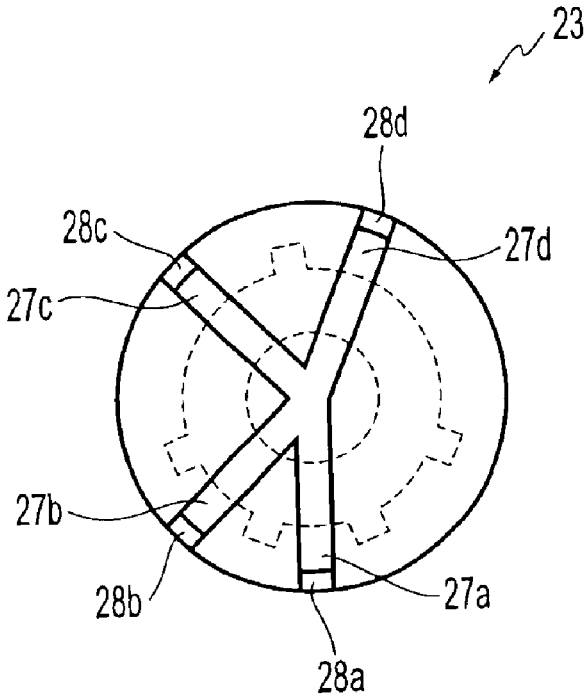
FIG. 6A is a plan view of the switching member.
Figure 6B:
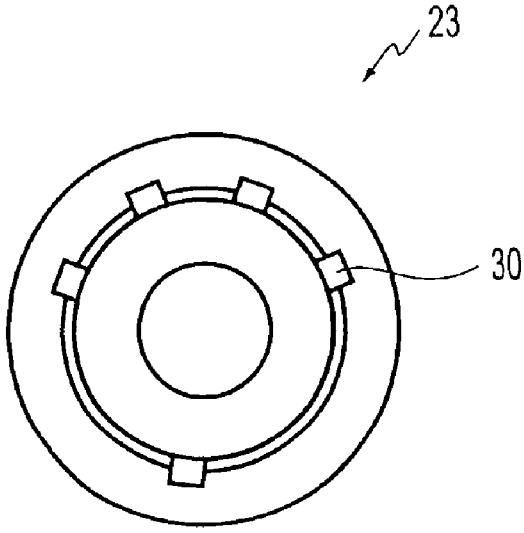
FIG. 6B is a bottom plan view of the switching member.

The switching member 23 is formed of elastic material, such as rubber. As shown in FIGS. 5 and 6A, the switching member 23 has grooves 27*a*–27*d* extending in different directions on the upper surface of the switching member 23. Each groove 27*a*–27*d* is connected to a side groove 28*a*–28*d*, respectively. The side groove 28*c* is formed deeper to allow the suction port 26*c* provided at the lower portion of the main body 22, as well as the suction ports 26*a*, 26*b*, 26*d* provided at the upper portion of the main body 22 to communicate with the side groove 28*c*. The other side grooves 28*a*, 28*b*, 28*d* are formed shallower to communicate with the suction ports 26*a*, 26*b*, 26*d*. Three ribs 29 are formed around the outer side surface of the switching member 23. The ribs 29 are formed to enclose right and left sides, as well as the bottom of each side groove 28*a*–28*d*. The ribs 29 are provided such that the diameter of the switching member 23 becomes slightly greater than the inside diameter of the main body 22. When the switching member 23 is fitted into the main body 22, the switching member 23 is pushed into the main body 22 with the ribs 29 deformed in the main body 22. With the ribs 29, a gap is prevented from being formed between the switching member 23 and the main body 22 by the deformation of the switching member 23 when the switching member 23 is rotated. Accordingly, the negative pressure is not unpreferably released through the gap. Due to the ribs 29, the switching member 23 and the main body 22 make an intimate contact with each other, although the gap tends to be formed if all the outer side surface of the switching member 23, except for the side grooves 28*a*–28*d*, contacts the inner surface of the main body 22. When the switching member 23 is fitted into the main body 22 during assembly processes, the switching member 23 and the main body 22 are readily assembled due to the ribs 29. As shown in FIG. 6B, the switching member 23 is provided with four recessed portions 30 along an inner circumferential surface thereof to allow the switching member 23 to rotate together with the switching gear member 24.

The switching gear member 24 is engaged with the switching member 23 by fitting the four recessed portions 30 over four protrusion provided on an upper outer surface of the switching gear member 24. The switching gear member 24 is provided at a lower portion thereof with a gear that engages with the switching idle gear 35. In accordance with the rotation of the maintenance motor 11, the switching gear member 24 performs the switching operation of the switch valve 15.

Referring back to FIG. 2, a drive system for the maintenance unit 10 will be described below. As shown in FIG. 2, the maintenance unit 10 has the maintenance motor 11 fixedly mounted thereon. The rotation of the maintenance motor 11 is transmitted to the gear 32*a*, through the gears 31*a*–31*d* and the large-diameter gear 32. The gear 32*a* is concentric with the large-diameter gear 32 and is a sun gear around which a planetary gear pivots. As the maintenance motor 11 rotates in the direction A, the large-diameter gear 32 is rotated in the direction A'. The pendulum gear (planetary gear) 33 engaging with the gear 32*a* is engaged with the pump idle gear 34, to move a pump gear that communicates with the suction pump 14. Thus, the suction pump 14 is actuated. When the maintenance motor 11 rotates in the direction B, the large-diameter gear 32 is rotated in the direction B'. Then, the rotation of the large-diameter gear 32 is transmitted to the switching gear member 24 of the switching valve 15, through the pendulum gear 33, the gears 31*e*–31*j* and the switching idle gear 35. In addition, the cam 16 is moved by the drive force transmitted through the gear 31*i* engaging with a gear portion of the cam 16.

Each of the tubes 17*a*–17*d* that connect the suction ports 26*b*, 26*a*, 26*c*, 26*d* and the caps 12*a*, 12*b*, the wiper 13 and the ink receive 9, respectively has the same diameter, which is relatively small. The tube 17*e* that connects the discharge port 25 and the suction pump 14 has a diameter larger than the tube 17*a*–17*d*. The suction pump tube 14*a* for use in the suction pump 14 has a diameter larger than the tube 17*e*. That is, the suction pump tube 14*a* has the largest diameter, the tube 17*e* has the second largest diameter, and the tubes 17*a*–17*d* have the smallest diameter.

Figure 7:
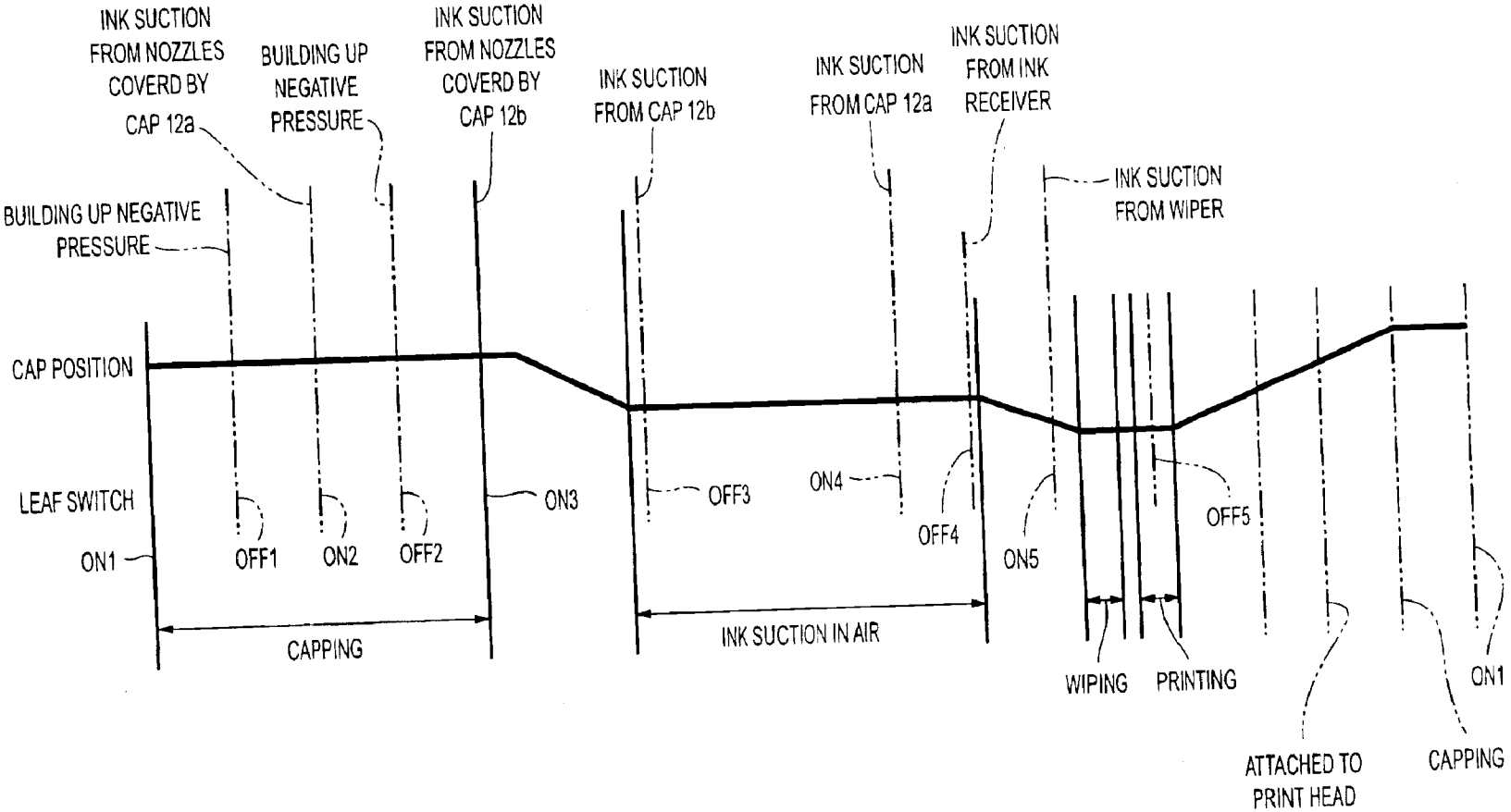
FIG. 7 is a timing chart showing operations of the maintenance unit.

With reference to FIG. 7, the operations of the maintenance unit 10 will be described below. All ink suction operations that can be performed in accordance with the rotation of the cam 16 will be described below. However, the ink suction operations do not always have to be performed in accordance with the rotation of the cam 16, but are performed as required. FIG. 7 is a timing chart showing operations of the maintenance unit 10. In "ON 1" condition in FIG. 7, the leaf switch 18 contacts the protrusion 19*a*, as shown in FIG. 2. At this time, the print head 2 is in a standby condition. In this state, the print head 2 is covered by the cap member 12, which is in the capping position. The suction port 26*b* faces the side groove 28*b*. The suction port 26*a* faces the side groove 28*c*. The suction port 26*d* faces the side groove 28*a*. Thus, communication between the switching valve 15 and the cap 12*a*, 12*b*, and the ink receiver 9 is established through the tubes 17*a*, 17*b*, 17*d*. The print head 2 placed in the standby condition communicates with the switching valve 15. The switching valve 15 always has some ink left therein, which prevents the print head 2 covered by the cap member 12 from drying.

As the maintenance motor 11 is rotated in the direction B to rotate the cam 16 in the counterclockwise direction in FIG. 2, the leaf switch 18 comes out of contact with the protrusion 19*a*, as indicated by "OFF 1" in FIG. 7. The "OFF 1" condition is such a condition that the negative pressure can be build up in the tube 17*e* for a time to suction the ink from the nozzles covered by the cap 12*a*, and the suction port 26*c* faces the side groove 28*a*. At this time, the switching valve 15 does not communicate with the air or atmosphere through any of the suction ports 26*a*–26*d*. This is because the suction port 26*c* facing the side groove 28*a* does not communicate with the side groove 28*a* due to the arrangement such that the suction port 26*a* is provided at the lower portion of the main body 22 and the side groove 28*a* is formed shorter in length. In this condition, the maintenance motor 11 is rotated in the direction A, to build up the negative pressure with the aid of the pressure application roller of the suction pump 14. In order to sufficiently build up the negative pressure, the inner diameter of the suction pump tube 14*a* is set greater than that of the tubes 17*a*–17*d* connecting between the switching valve 15 and the suction openings formed in the caps 12*a*, 12*b*, the wiper 13 and the ink receiver 9. Further, the inner diameter of the suction pump tube 14*a* is set greater than that of the tube 17*e* connecting the switching valve 15 and the suction pump 14. While the negative pressure is being build up, communication between the switching valve 15 and the caps 12*a*, 12*b*, the wiper 13, and the ink receiver 9, is not established. With the structure such that the inside diameter of the tubes 17*a*-17*d* connecting the switching valve 15 and the caps 12*a*, 12*b*, the wiper 13, and the ink receiver 9 is smaller than that of the tube 17*e* connecting the switching valve 15 and the suction pump 14, the negative pressure is applied effectively while minimizing the reduction of the negative pressure. In addition, the grooves 27*a*–27*d* are formed on the upper surface of the switching member 23. Therefore, even when the upper surface of the switching member 23 makes an intimate contact with the upper inner surface of the main body 22 due to the application of the negative pressure, the negative pressure is applied to the side groove 28*a*–28*d* through the groove 27*a*–27*d*.

As the maintenance motor 11 is rotated again in the direction B, the leaf switch 18 comes into contact with the protrusion 19*b*, as indicated by "ON 2" in FIG. 7, and the ink is suctioned from the nozzles covered by the cap 12*a*. In "ON 2" condition, the suction port 26*b* and the side groove 28*a* face each other. The switching valve 15 communicates with the cap 12*a*, through the tube 17*a*. The negative pressure being built up during the previous "OFF 1" condition is released to suction the ink from the nozzles covered by the cap 12*a*. The inner diameter of the tube 17*a* connecting the suction opening of the cap 12*a* and the suction port 26*b* is relatively small, so that the reduction of the negative pressure can be minimized when the communication is established between the suction port 26*b* and the suction opening formed in the cap 12*a*. Accordingly, the ink is suctioned from the nozzles of the print head 2 with the great negative pressure.

As the leaf switch 18 comes out of contact with the protrusion 19*b*, as indicated by "OFF 2" in FIG. 7, the negative pressure can be build up in the tube 17*e* for a time to suction the ink from the nozzles covered by the cap 12*b*. At this time, no suction ports 26*a*–26*d* face any side groove 28*a*–28*d*. Therefore, the switching valve 15 does not communicate with the air through the suction ports 26*a*–26*d*. In this state, the negative pressure is build up with the aid of the pressure application roller of the suction pump 14.

As the leaf switch 18 comes into contact with the protrusion 19*c*, as indicated by "ON 3" in FIG. 7, the ink is suctioned from the nozzles covered by the cap 12*b*. In "ON 3" condition, the suction port 26*a* and the side groove 28*b* face each other. The switching valve 15 communicates with the cap 12*b*, through the tube 17*b*. The negative pressure being built up during the previous "OFF 2" condition is released to suction the ink from the nozzles covered by the cap 12*b*. After the ink is suctioned from the nozzles covered by the cap 12*b*, the caps 12*a*, 12*b* are moved down away from the print head 2, in accordance with the movement of the cam 16.

As the leaf switch 18 comes out of contact with the protrusion 19*c*, as indicated by "OFF 3" in FIG. 7, the ink is suctioned in air from the cap 12*b*. In "OFF 3" condition, the suction port 26*a* faces the side groove 28*a*. The switching valve 15 communicates with the cap 12*b*, through the tube 17*b*. In this state, the suction pump 14 is driven to suction the ink remaining in the cap 12*b*.

As the leaf switch 18 comes into contact with the protrusion 19*d*, as indicated by "ON 4" in FIG. 7, the ink is suctioned in air from the cap 12*a*. In "ON 4" condition, the suction port 26*b* and the side groove 28*d* face each other. The switching valve 15 communicates with the cap 12*a*, through the tube 17*a*. In this state, the suction pump 14 is driven to suction the ink remaining in the cap 12*a*.

As the leaf switch 18 comes out of contact with the protrusion 19*d*, as indicated by "OFF 4" in FIG. 7, the ink is suctioned from the ink receiver 9. In "OFF 4" condition, the suction port 26*d* faces the side groove 28*c*. The switching valve 15 communicates with the ink receiver 9, through the tube 17*d*. The ink ejected onto the ink receiver 9 during the flushing operation performed to recover an ink ejection performance is suctioned from the ink receiver 9, through the tube 17*d*. Thereafter, the caps 12*a*, 12*b* are lowered in accordance with the movement of the cam 16.

As the leaf switch 18 comes into contact with the protrusion 19*e*, as indicated by "ON 5" in FIG. 7, the ink is suctioned from the wiper 13. In "ON 5" condition, the suction port 26*c* and the side groove 28*c* face each other. The switching valve 15 communicates with the wiper 13, through the tube 17*c*. The ink that has been accumulated on the wiper 13 during the wiping operation is suctioned from the wiper 13. Thereafter, the caps 12*a*, 12*b* are further lowered in accordance with the movement of the cam 16, reaching a lowermost uncapping position. When the caps 12*a*, 12*b* are in the lowermost uncapping position, the wiper 13 is in a position raised by the cam 16*a* of the cam 16 during the time indicated as "WIPING" in FIG. 7. The raised position of the wiper 13 is a wiping position where the wiper 13 can contact the nozzle surface of the print head 2. When the wiper 13 is in the wiping position, the ink attached to the nozzle surface of the print head 2 during the cleaning operation for the print head 2, is wiped off by the wiper 13 as the carriage 16 is moved.

During the time indicated as "PRINTING" in FIG. 7, the wiper 13 is in a retracted position as the cam 16*a* of the cam 16 does not act on the wiper 13. In this state, none of the caps 12*a*, 12*b* and the wiper 13 acts on the print head 2, so that the print head 2 can eject the ink onto the recording medium according to the movement of the carriage 6.

As the carriage 6 returns to the standby area after the printing operation with the print head 2 has been finished, the cam 16 starts to rotate again. As the leaf switch 18 comes out of contact with the protrusion 19*e*, as indicated by "OFF 5" in FIG. 7, in accordance with the rotation of the cam 16, the caps 12*a*, 12*b* are again raised to cap the print head 2 and to place the print head 2 in the standby condition. As described above, the caps 12*a*, 12*b* are moved up in association with the movement of the cam 16. At the same time, the switching valve 15 is rotated through the gears 31*e*, 31*j* and the switching idle gear 35, so that the main body 22 and the switching member 23 of the switching valve 15 slide relative to each other during the movement of the caps 12*a*, 12*b*. The switching member 23 is tightly fitted into the main body 22 and frictional resistance therebetween is large. Therefore, even when the caps 12*a*, 12*b* try to move quickly in the upward direction in accordance with the movement of the cam 16, the quick or sudden movement of the cam 16 is restricted by the switching valve 15. Accordingly, the caps 12*a*, 12*b* are raised slowly. Therefore, adverse effects such as meniscus damages due to the application of pressure to the nozzles when the caps 12*a*, 12*b* attach to the print head 2, can be prevented.

As described above, the ink discharged during the cleaning, wiping and flushing operations is suctioned using the suction pump 14 from the suction opening provided for each of the caps 12*a*, 12*b*, the wiper 13, and the ink receiver 9, through the tubes 17*a*–17*d*. The suction opening of the caps 12*a*, 12*b*, the wiper 13, and the ink receiver 9 are connected to the suction port 26*b*, 26*a*, 26*c*, 26*d* of the switching valve 15 through the tubes 17*a*–17*d*. The suction port 26*a*—26*d* is brought into communication with the side groove 28*a*–28*d* formed on the switching member 23 according to the rotation of the switching valve 15. Thus, the ink is suctioned selectively from the caps 12*a*, 12*b*, the wiper 13, and the ink receiver 9, with the suction pump 14. With this structure, the ink discharged during the cleaning, wiping and flushing operations can be collected to one location by the switching made by the switching valve 15. Thus, the discharged ink collection can be achieved by the compact maintenance unit 10. Communication established between the caps 12*a*, 12*b* and the switching valve 15 can prevent the nozzles covered by the caps 12*a*, 12*b* from drying when the print head 2 is in the standby condition, due to the ink remaining in the switching valve 15. To suction the ink from the nozzles of the print head 2, the negative pressure is built up using the tube-type suction pump 14 for a time in the tube 17*e* connecting the suction pump 14 and the switching valve 15. The tube 17*e* has a larger inner diameter to effectively build up the negative pressure. The tube 17*a*, 17*b* connecting between the caps 12*a*, 12*b* and the switching valve 15 has an inner diameter smaller than that of the tube 17*e*. With this structure, reduction of the negative pressure when the tube 17*e* is brought into communication with the tube 17*a*, 17*b* by the switching valve 15, is minimized. Accordingly, the great negative pressure can be effectively applied to the print head 2 to suction the ink from the nozzles of the print head 2.

While the invention has been described with reference to the embodiments, it is to be understood that the invention is not restricted to the particular forms shown in the foregoing embodiment. Various modifications and alterations can be made thereto without departing from the scope of the invention, as set forth in the appended claims.

What is claimed is:

1. An ink jet recording apparatus, comprising:

a print head having nozzles, the print head forming an image onto a recording medium by ejecting ink from the nozzles;

a cap member that covers the nozzles of the print head;

a wiping member that wipes off the ink on a nozzle surface;

an ink receiver that receives the ink ejected from the nozzles at a region outside an image recordable area with the print head, a suction pump for suctioning the ink; and a switching mechanism that communicates with the cap member, the wiping member, the ink receiver, and the suction pump, the switching mechanism allowing the suction pump to selectively communicate with the cap member, the wiping member, and the ink receiver.

2. The ink jet recording apparatus according to claim 1, wherein the switching mechanism includes:

a cylindrical main body;

a discharge port provided on an upper surface of the main body; the discharge port communicating with the suction pump;

a plurality of suction ports provided on an outer circumferential surface of the main body, each of the suction ports communicating with one of the cap member, the wiping member, and the ink receiver;

a switching member rotatably fitted into the main body;

a plurality of grooves formed on an upper surface and an outer circumferential surface of the switching member, the grooves formed on the upper surface of the switching member communicating with the discharge port, and the grooves formed on the outer circumferential surface of the switching member communicating with the suction ports; and a gear member connected to the switching member, the gear member rotating the switching member relative to the main body.

3. The ink jet recording apparatus according to claim 2, wherein at least one of the suction ports and the other suction ports are disposed on different levels on the outer circumferential surface of the main body.

4. The ink jet recording apparatus according to claim 3, further comprising a plurality of ribs that are provided on the outer circumferential surface of the switching member and enclose the grooves formed on the outer circumferential surface of the switching member.

5. The ink jet recording apparatus according to claim 4, further comprising:

a spring that urges the cap member toward the print head;

a cam that moves the cap member away from the print head; and a driving mechanism connected to the cam and the gear member; and wherein an outside diameter of the switching member including a portion where the ribs are formed is greater than an inside diameter of the main body.

6. The ink jet recording apparatus according to claim 2, further comprising:

a first tube that connects the discharge port and the suction pump; and a second tube that connects one of the suction ports and the cap member; and wherein an inner diameter of the second tube is smaller than an inner diameter of the first tube.

7. An ink jet recording apparatus, comprising:

a print head having a plurality of nozzles, the print head forming an image onto a recording medium by ejecting ink from the plurality of nozzles;

a cap member that covers the plurality of nozzles, the cap member having at least one cap;

a wiping member that wipes off the ink on a nozzle surface;

an ink receiver that receives the ink ejected from the plurality of nozzles at a region outside an image recordable area with the print head, a suction pump for suctioning the ink;

a switching mechanism that communicates with the cap member, the wiping member, the ink receiver, and the suction pump, the switching mechanism allowing the suction pump to selectively communicate with the cap member, the wiping member, and the ink receiver;

a spring that forces the cap member toward the print head;

a cam that moves the cap member away from the print head; and a motor coupled to the cam.

8. The ink jet recording apparatus according to claim 7, wherein one or more of the motor, the suction pump, the switching mechanism and the cam are coupled to each other through one or more coupling gears.

9. The ink jet recording apparatus according to claim 8, further comprising:

a first tube that connects the discharge port and the suction pump; and a second tube that connects one of the suction ports and the cap member; and wherein an inner diameter of the second tube is smaller than an inner diameter of the first tube.

10. The ink jet recording apparatus according to claim 8, wherein at least one of the suction ports is disposed on a different plane level relative to the other suction ports on the outer circumferential surface of the main body.

11. The ink jet recording apparatus according to claim 10, further comprising a plurality of ribs that are provided on the outer circumferential surface of the switching member, the ribs enclosing the grooves formed on the outer circumferential surface of the switching member.

12. The ink jet recording apparatus according to claim 11, wherein an outside diameter of the switching member including a portion where the ribs are formed is greater than an inside diameter of the main body.

13. The ink jet recording apparatus according to claim 7, wherein the switching mechanism includes:

a cylindrical main body;

a discharge port provided on an upper surface of the main body, the discharge port communicating with the suction pump;

a plurality of suction ports provided on an outer circumferential surface of the main body; each of the suction ports communicating with one cap of the cap member, the wiping member, and the ink receiver;

a switching member rotatably fitted into the main body;

a plurality of grooves formed on an upper surface and an outer circumferential surface of the switching member, the grooves formed on the upper surface of the switching member communicating with the discharge port, and the grooves formed on the outer circumferential surface of the switching member communicating with the suction ports; and a gear member connected to the switching member, the gear member rotating the switching member relative to the main body.

14. The ink jet recording apparatus according to claim 13, wherein the main body is formed of resin material.

15. A switching mechanism, comprising:

a cylindrical main body;

a discharge port provided on an upper surface of the main body;

a plurality of suction ports provided on an outer circumferential surface of the main body;

a switching member rotatably fitted into the main body;

a plurality of grooves formed on an upper surface and an outer circumferential surface of the switching member, the grooves formed on the upper surface of the switching member communicating with the discharge port, and the grooves formed on the outer circumferential surface of the switching member communicating with the suction ports; and a gear member connected to the switching member, the gear member rotating the switching member relative to the main body.

16. The switching mechanism according to claim 15, wherein at least one of the suction ports and the other suction ports are disposed on different levels on the outer circumferential surface of the main body.

17. The switching mechanism according to claim 16, further comprising a plurality of ribs that are provided on the outer circumferential surface of the switching member and enclose the grooves formed on the outer circumferential surface of the switching member.

18. The switching mechanism according to claim 17, wherein an outside diameter of the switching member including a portion where the ribs are formed is greater than an inside diameter of the main body.

19. The switching mechanism according to claim 15, wherein the main body is formed of resin material.

20. A switching mechanism, comprising:

a cylindrical hollow main body;

a discharge port provided on an upper surface of the main body;

a plurality of suction ports provided on an outer circumferential surface of the main body;

a cylindrical switching member including an outer peripheral surface, at least a portion of the outer peripheral surface being of a diameter greater than an inside diameter of the main body, the switching member rotatably fitted into the main body; and a plurality of grooves formed on an upper surface and the outer peripheral surface of the switching member, the grooves communicating with each other, the grooves formed on the upper surface of the switching member communicating with the discharge port, and the grooves formed on the outer peripheral surface of the switching member communicating with the suction ports.

21. The switching member according to claim 20, wherein the suction ports are spaced away from each other in a direction that the switching member rotates.

* * * * *